US006141510A

United States Patent [19]

Yamamoto

[11] Patent Number: 6,141,510

[45] Date of Patent: Oct. 31, 2000

[54] TONER CONCENTRATION DETECTING METHOD AND SYSTEM

[75] Inventor: Shinya Yamamoto, Niigata, Japan

[73] Assignee: NEC Corporation, Tokyo, Japan

[21] Appl. No.: 09/135,524

[22] Filed: Aug. 18, 1998

[30] Foreign Application Priority Data

Aug. 18, 1997 [JP] Japan ..... 9-221668

[51] Int. Cl.[7] ..... G03G 15/08

[52] U.S. Cl. ..... 399/60

[58] Field of Search ..... 399/30, 53, 55, 399/58, 60; 118/690

[56] References Cited

U.S. PATENT DOCUMENTS

| | | | |
|---|---|---|---|
| 4,492,179 | 1/1985 | Folkins et al. | 399/55 |
| 4,536,082 | 8/1985 | Motohashi et al. | 399/51 |
| 4,786,924 | 11/1988 | Folkins | 399/49 |
| 5,034,775 | 7/1991 | Folkins | 399/55 |
| 5,150,135 | 9/1992 | Casey et al. | 347/125 |
| 5,416,564 | 5/1995 | Thompson et al. | 399/27 |
| 5,521,683 | 5/1996 | Miyamoto et al. | 399/55 |

FOREIGN PATENT DOCUMENTS

| | | |
|---|---|---|
| 61-153677 | 7/1986 | Japan . |
| 1-217377 | 8/1989 | Japan . |
| 3-075674 | 3/1991 | Japan . |
| 3-295453 | 12/1991 | Japan . |
| 4-170558 | 6/1992 | Japan . |
| 4-204878 | 7/1992 | Japan . |
| 5-224534 | 9/1993 | Japan . |
| 8-146775 | 6/1996 | Japan . |

*Primary Examiner*—Robert Beatty
*Attorney, Agent, or Firm*—Young & Thompson

[57] ABSTRACT

A method for detecting a toner concentration of a developer including toner particles provides that when developing a latent image having a predetermined area formed on a photoconductor using a developing member, a developing current flowing through the developing member is detected, and the toner concentration is calculated directly from the detected developing current and the predetermined toner developed area of the latent image obtained by counting toner dots in the predetermined area.

8 Claims, 4 Drawing Sheets

TONER CONCENTRATION DETECTING METHOD AND SYSTEM

BACKGROUND OF THE INVENTION

1. Field of the Invention

The present invention generally relates to toner concentration control technique for use in electrophotographic equipment.

2. Description of the Related Art

There has been proposed a toner concentration detection technique making use of electric conductivity of liquid developer in Japanese Patent Unexamined Publication No. 3-295453. The electric conductivity is measured using alternating current because direct current measurement causes movement of ionic carriers and polarization by which voltage drops are caused around electrodes. The measurement frequency is determined depending on the frequency response of the object. In the case of liquid developer, a frequency of 1 kHz may be preferably used.

However, there occurs an increase in the number of ionic contaminants or the like due to deterioration of liquid developer. Such Ionic contaminants or the like become a factor that substantially influences the measurement, resulting in a lower degree of measurement accuracy.

SUMMARY OF THE INVENTION

An object of the present invention is to provide a toner concentration detecting method and system which can measure the toner concentration with high accuracy.

Another object of the present invention is to provide a toner concentration controller which can keep the toner concentration optimally.

According to the present invention, a developing current flowing when the developing process is performed is used to estimate the toner concentration. A method for detecting a toner concentration of a developer including toner particles, comprises the steps of: developing a latent image having a predetermined area formed on a photoconductor using a developing member to move toner particles from the developing member to the photoconductor; detecting a developing current flowing through the developing member when the latent image is developed; and calculating the toner concentration based on the developing current and a toner developed area of the latent image.

The toner concentration may be calculated using a predetermined relationship among a developing current, a toner concentration, and a toner developed area of a latent image.

According to an aspect of the present invention, the latent image is a predetermined image pattern having a predetermined toner developed area. The toner concentration may calculated using a predetermined relationship between a developing current and a toner concentration when the latent image has the predetermined toner developed area.

According to another aspect of the present invention, a toner developed area of the latent image is obtained by counting toner dots included in the predetermined area based on image data which is used to form the latent image on the photoconductor. The toner concentration may be calculated using a predetermined relationship among a developing current, a toner concentration, and a toner developed area of a latent image.

As described above, a developing current flowing on the developing process is detected and is used to estimate the toner concentration. Therefore, the toner concentration can be obtained accurately. For example, the measurement of the toner concentration is unaffected by an increase in the number of ionized impurities or the like due to deterioration of liquid developer.

DETAILED DESCRIPTION OF THE PREFERRED EMBODIMENT

Figure 1:
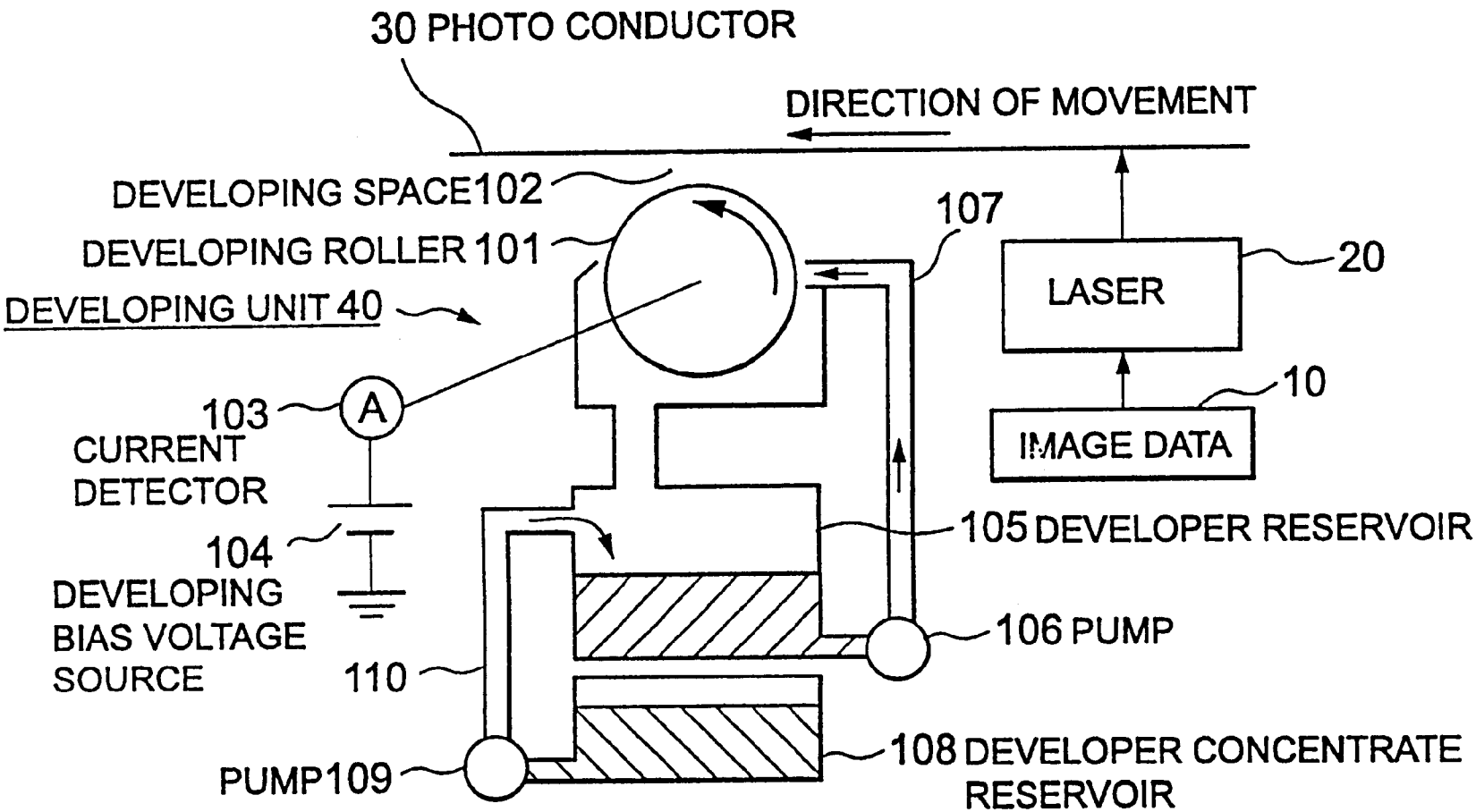
FIG. 1 is a schematic diagram showing the construction of a developing unit in a toner concentration control system according to an embodiment of the present invention.

Referring to FIG. 1, an image forming apparatus is comprised of an image input device 10, a laser 20, a photoconductor 30, and a developing unit 40. The image input device 10 may be a scanner or an image processor which produces image data which can be directly used to form an image. The laser 20 is driven to emit laser light depending on the bit-map image data. The photoconductor 30 which is electrostatically charged to a high voltage (e.g. +700V) by a charging section (not shown) and is moving with controlled timing is exposed to the laser light. The voltage of exposed surfaces of the photoconductor 30 decreases to a lower voltage (e.g. +100V) to form a latent electrostatic image thereon. The exposure process is followed by the developing process. The latent image on the photoconductor 30 is developed by the developing unit 40.

The developing unit 40 is composed of a developing roller 101 which is opposite to the photoconductor 30 with the developing space 102 between them. The developing roller 101 is connected to a current detector 103 and a developing bias voltage source 104 which biases the developing roller 101 to allow charged toner particles to move from the developing roller 101 to the latent image of the photoconductor 30. Here, the bias voltage of the developing bias voltage source 104 is set to a voltage between the high voltage and the lower voltage of the latent electrostatic image on the photoconductor 30. As will be described in detail, the movement of the charged toner particles from the developing roller 101 to the photoconductor 30 causes a developing current to flow depending on the amount of moving charged toner. Such a developing current is detected by the current detector 103.

The developing unit 40 is provided with a developer reservoir 105 for storing liquid developer including toner particles. The liquid developer is supplied to the developing roller 101 by a pump 106 through a developer supplying line 107. An excess of the liquid developer flows back to the developer reservoir 105. Since some toner particles are transferred to the developing roller 101, the toner concentration of the liquid developer stored in the developer reservoir 105 is gradually decreased.

The developing unit 40 is further provided with a developer concentrate reservoir 108 for storing concentrated liquid developer. The concentrated liquid developer is supplied to the developer reservoir 105 by a concentrate supplying pump 109 through a developer concentrate supplying line 110. As will be described, when it is determined that the toner concentration is lower than a predetermined value, the concentrate supplying pump 109 is driven to supply the concentrated developer to the developer reservoir 105 so as to increase the toner concentration.

Figure 2:
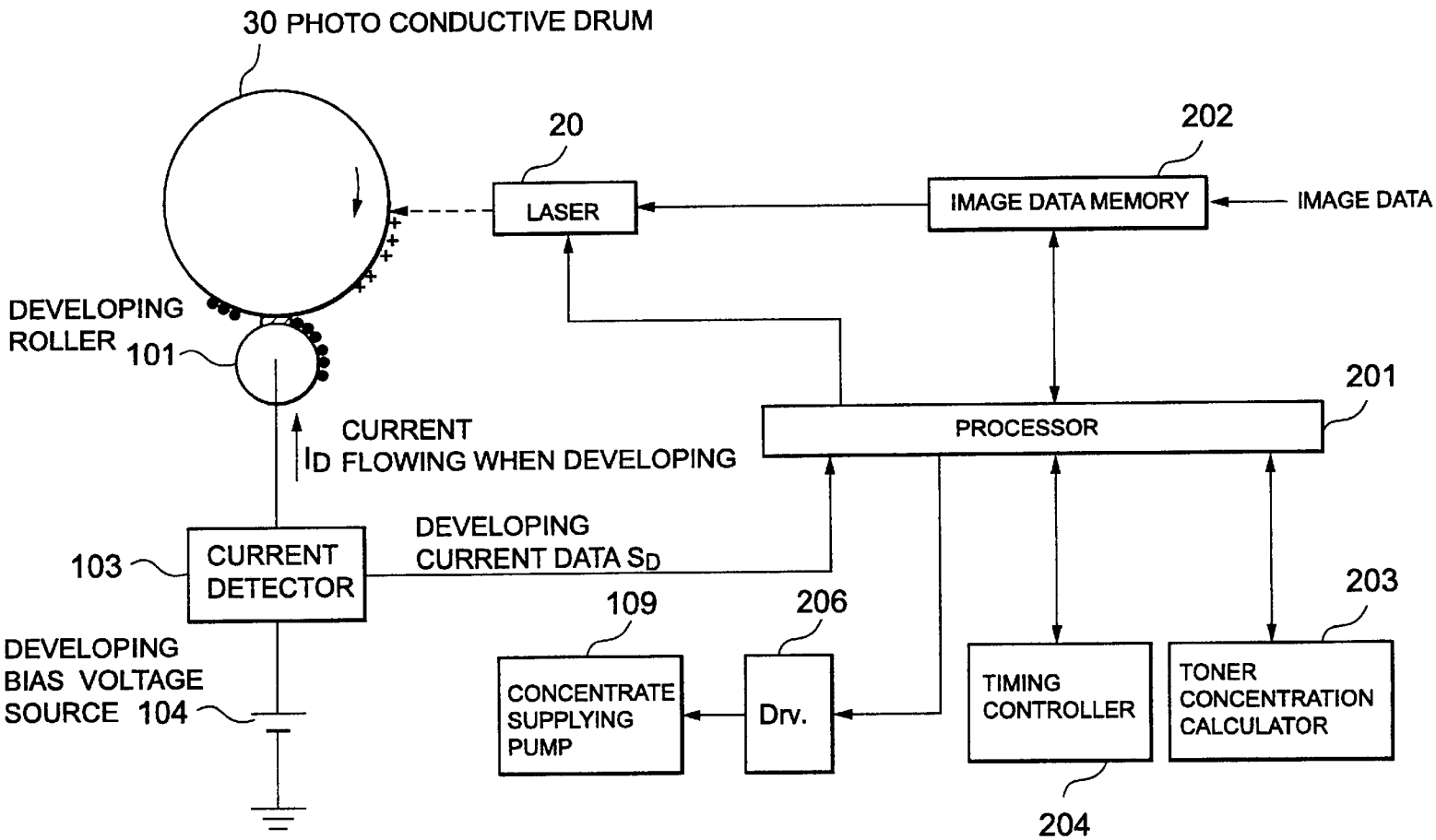
FIG. 2 is a block diagram showing the toner concentration control system according to the embodiment.

Referring to FIG. 2, where circuit blocks similar to those previously described with reference to FIG. 1 are denoted by the same reference numerals, the control system includes a processor 201 which runs control programs stored in read-only memory (not shown). When receiving the image data, processor 201 stores the image data onto the image data memory 202. The image data can be used directly to form a latent image on the photoconductive drum 30 by driving the laser 20.

The input image data can be used to detect the toner concentration by determining the effective area of image. Alternatively, a predetermined pattern dedicated to the toner concentration detection can be also used. The predetermined pattern data may be stored onto the image data memory 202 and then the pattern is formed in the margin of a page under control of the processor 201.

The processor 201 uses a toner concentration calculator 203 to determine the toner concentration of the developer reservoir 105. More specifically, the toner concentration calculator 203 receives current data $S_D$ representing the developing current $I_D$ from the current detector 103 and integrates it during a predetermined time period of the developing process. The current data $S_D$ or its integral and the effective area of image can be used to determine the toner concentration (see FIG. 3).

The processor 101 uses a timing controller 204 to control the timing of the movements of photoconductive drum 30, the developing roller 101 and other components. Therefore, the processor 201 can start Inputting the current data $S_D$ from the current detector 103 when the latent image on the photoconductive drum 30 formed by the laser 20 reaches the position of the developing roller 101.

When the toner concentration has been obtained, the processor 201 compares the toner concentration to a predetermined threshold value. If the toner concentration is smaller than the predetermined threshold value, the processor 201 controls a driver 206 for driving the concentrate supplying pump 109. This causes the concentrated liquid developer to be supplied from the developer concentrate reservoir 108 to the developer reservoir 105, resulting in increased toner concentration of the developer reservoir 105.

Figure 3:
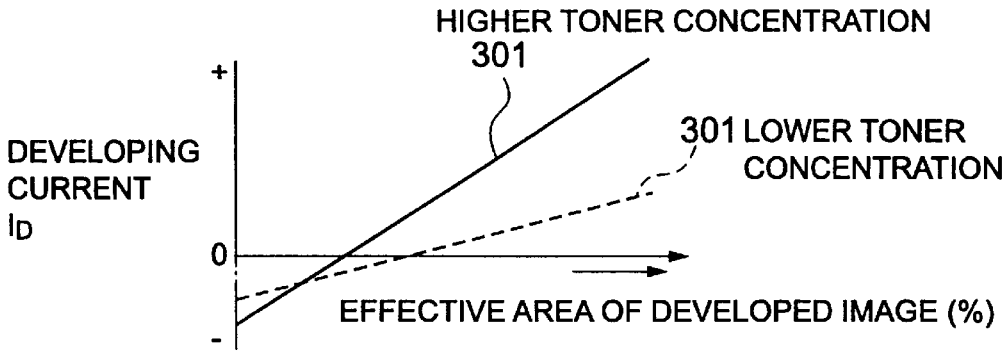
FIG. 3 is a graph showing the relationship among a developing current, toner concentration and an area of image.

As shown in FIG. 3, the inventor found that the developing current $I_D$ varies linearly with the effective area of developed image on the photoconductive drum 30. Further, the slope of the straight line becomes larger as the toner concentration is higher. Because the movement of the charged toner particles from the developing roller 101 to the photoconductor 30 causes the developing current $I_D$ to flow depending on the amount of moving charged toner. Therefore, by detecting the developing current $I_D$ on condition that the effective area of developed image is predetermined, the toner concentration can be determined.

The effective area is obtained as a ratio of toner area to a reference area. There are two ways to obtain the effective area. One is to use a predetermined image pattern with a prescribed effective area and the other is to count toner dots to be developed from the image data.

Figure 4:
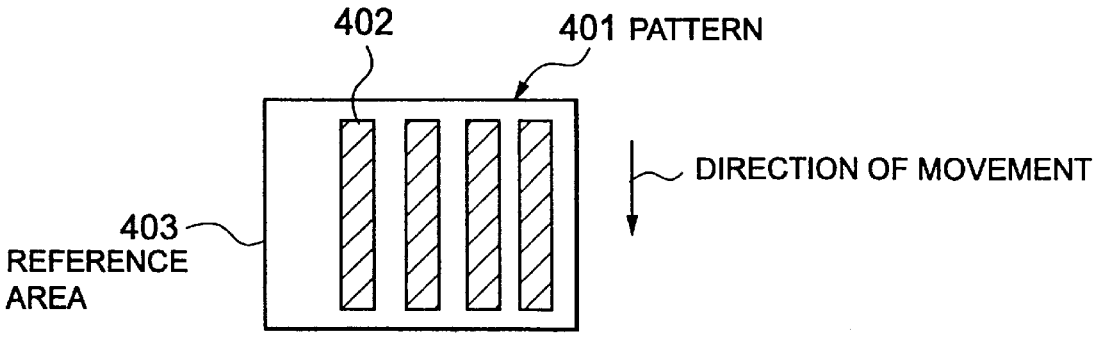
FIG. 4 is a flow chart showing a control flow of the toner concentration control system according to the embodiment.

Referring to FIG. 4, the predetermined pattern 401 dedicated to the toner concentration detection is composed of an array of a plurality of line segments 402 parallel to each other in the direction of movement of the photoconductive drum 30. The effective area of the predetermined pattern 401 is calculated by dividing the reference area 403 by the sum of the areas of the line segments 402. The pattern 401 is preferably formed at a predetermined position out of a normally used region of the photoconductive drum 30 because the pattern 401 is not printed but developed only. Further the pattern 401 may be formed between pages so that the developing current $I_D$ can be detected effectively. Since the predetermined pattern has a preset effective area and the line segments 402 are arrayed in parallel to the direction of movement, the toner concentration can be determined by only detecting the developing current $I_D$.

In the case where the effective area of image is calculated from the image data, it is first necessary to determine the detection area of a page. The whole area or a partial area of a page may be used. In this embodiment, the first half of a page area is used to detect the developing current $I_D$. In this case, the processor 201 inputs the half-page data of the image data corresponding to the first half of a page area from the image data memory 202. The processor 201 counts toner dots to be developed in the half page and calculates the effective area by dividing the predetermined number of dots included in the half page by the counted number of the toner dots. Therefore, the toner concentration can be determined by calculating the effective area and the integral of the developing current $I_D$ during the developing process of the first half of the page.

Figure 5:
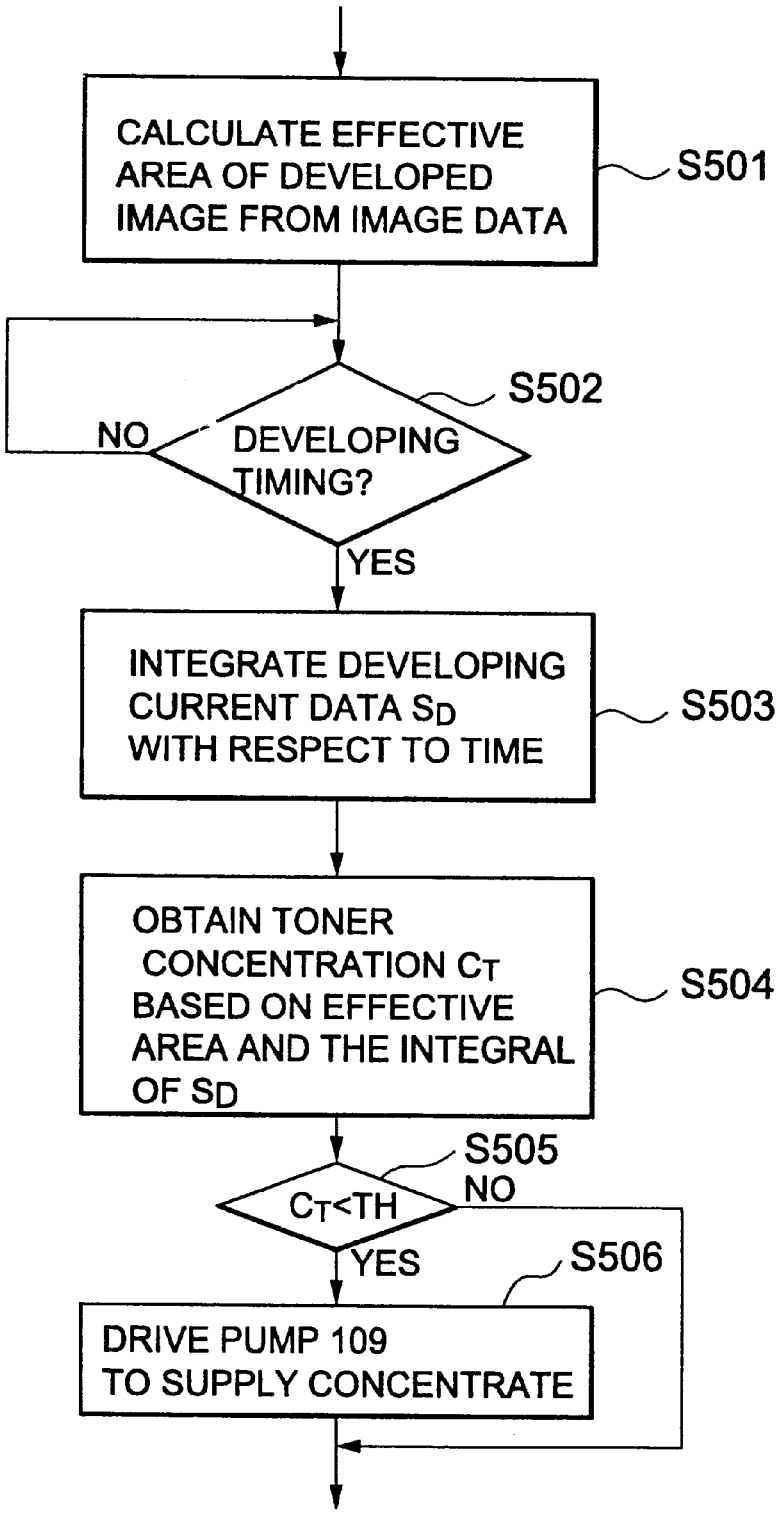
FIG. 5 is a flow chart showing the case where the effective area of the image is calculated from the image data.

Referring to FIG. 5, there is shown a control flow in the case where the effective area of image is calculated from the image data. When the image data has been stored onto the image data memory 202, the processor 201 reads the half-page data corresponding to the first half of a page area from the image data memory 202 and calculates the effective area of a predetermined part of the page as described above (step S501). Thereafter, the laser 20 is driven according to the image data stored in the image data memory 202, so that the latent image corresponding to the image data is formed on the photoconductive drum 30 rotating under control of the timing controller 204.

When the corresponding latent image on the photoconductive drum 30 reaches the position of the developing roller 101 (YES in step S502), the processor 201 starts inputting the current data $S_D$ from the current detector 103. The processor 201 integrates the current data $S_D$ with respect to time during the developing process of the corresponding latent image (step S503). Needless to say, the developing process of the remaining parts are continued.

When the integral of the current data $S_D$ has been calculated, the toner concentration calculator 203 receives the effective area of the predetermined part of the page and the integral of the current data $S_D$ from the processor 201 and calculates a toner concentration $C_T$ using the relationship as shown in FIG. 3 (step S504). More specifically, the toner concentration calculator 203 is comprised of a table containing the relationship as shown in FIG. 3 and searches the table for the effective area of the predetermined part of the page and the integral of the current data $S_D$ to produce the corresponding toner concentration $C_T$. The calculated toner concentration $C_T$ is sent back to the processor 201.

The processor 201 determines whether the toner concentration $C_T$ is smaller than a predetermined threshold value TH (step S505). If the toner concentration $C_T$ is smaller than the predetermined threshold value TH (YES in step S505), the processor 201 drives the concentrate supplying pump 109 so that the concentrated liquid developer is supplied from the developer concentrate reservoir 108 to the developer reservoir 105 and the toner concentration of the developer reservoir 105 is increased (step S506). The amount of the supplied concentrated liquid developer may be determined depending on a difference of the toner concentration $C_T$ and the predetermined threshold value TH. In this manner, the toner concentration of the developer reservoir 105 is optimally kept.

In the case where the predetermined pattern 401 dedicated to the toner concentration detection as shown in FIG. 4 is used, the control flow is basically the same as in FIG. 5. Since the effective area of the predetermined pattern 401 is determined in advance, the step S501 is not needed. Further, since the line segments of the pattern 401 are arrayed in parallel to the direction of movement as shown in FIG. 4, the step S504 is modified such that the toner concentration can be determined by only detecting the developing current $I_D$.

What is claimed is:

1. A method for detecting a toner concentration of a developer including toner particles, comprising the steps of:

developing a latent image having a predetermined area formed on a photoconductor using a developing member to move toner particles from the developing member to the photoconductor;

detecting a developing current flowing through the developing member when the latent image is developed; and calculating the toner concentration based on the developing current and a toner developed area of the latent image, wherein a toner developed area of the latent image is obtained by counting toner dots included in the predetermined area based on image data which is used to form the latent image on the photoconductor.

2. The method according to claim 1, wherein the toner concentration is calculated using a predetermined relationship among a developing current, a toner concentration, and a toner developed area of a latent image.

3. A control method for controlling a toner concentration of a developer including toner particles, comprising the steps of:

developing a latent image having a predetermined area formed on a photoconductor using a developing member to move toner particles from the developing member to the photoconductor;

detecting a developing current flowing through the developing member when the latent image is developed;

calculating the toner concentration based on the developing current and a toner developed area of the latent image;

comparing the toner concentration to a predetermined value; and supplying toner particles to the developer when the toner concentration is lower than the predetermined value, wherein a toner developed area of the latent image is obtained by counting toner dots included in the predetermined area based on image data which is used to form the latent image on the photoconductor.

4. The control method according to claim 3, wherein the toner concentration is calculated using a predetermined relationship among a developing current, a toner concentration, and a toner developed area of a latent image.

5. An apparatus for detecting a toner concentration of a developer including toner particles in electrophotographic equipment, comprising:

a developing member for developing a latent image having a predetermined area formed on a photoconductor by moving toner particles from the developing member to the photoconductor;

a current detector connected to the developing member, for detecting a developing current flowing through the developing member when the latent image is developed; and a processor for calculating the toner concentration based on the developing current and a toner developed area of the latent image, wherein the processor calculates a toner developed area of the latent image by counting toner dots included in the predetermined area based on image data which is used to form the latent image on the photoconductor.

6. The apparatus according to claim 5, wherein the processor stores a predetermined relationship among a developing current, a toner concentration, and a toner developed area of a latent image and calculates the toner concentration using the predetermined relationship.

7. A system for controlling a toner concentration of a developer including toner particles in electrophotographic equipment, comprising:

a developer reservoir for storing the developer;

a concentrate reservoir for storing a concentrated developer;

a supplying pump for supplying the concentrated developer to the developer reservoir;

a developing member making contact with the developer, for developing a latent image having a predetermined area formed on a photoconductor by moving toner particles from the developing member to the photoconductor;

a current detector connected to the developing member, for detecting a developing current flowing through the developing member when the latent image is developed;

a calculator for calculating the toner concentration based on the developing current and a toner developed area of the latent image; and a controller for comparing the toner concentration to a predetermined value and, when the toner concentration is lower than the predetermined value, driving the supplying pump to supply the concentrated developer to the developer reservoir, wherein the calculator calculates a toner developed area of the latent image by counting toner dots included in the predetermined area based on image data which is used to form the latent image on the photoconductor.

8. The system according to claim 7, wherein the calculator stores a predetermined relationship among a developing current, a toner concentration, and a toner developed area of a latent image and calculates the toner concentration using the predetermined relationship.

* * * * *